United States Patent [19]

Devenny

[11] Patent Number: 4,559,675

[45] Date of Patent: Dec. 24, 1985

[54] CORSAGE SUPPORT

[76] Inventor: Kirk Devenny, P.O. Box 111, Munster, Ontario, Canada, K0A 3P0

[21] Appl. No.: 561,735

[22] Filed: Dec. 15, 1983

[30] Foreign Application Priority Data

Jan. 6, 1983 [CA] Canada ..... 418989

[51] Int. Cl.[4] ..... A45F 5/08

[52] U.S. Cl. ..... 24/5; 24/6; 24/460; 24/462

[58] Field of Search ..... 24/5, 6, 7, 3 R, 622, 24/623, 624, 682, 691, 692, 673, 460, 461, 462

[56] References Cited

U.S. PATENT DOCUMENTS

| | | | |
|---|---|---|---|
| 333,590 | 1/1886 | Benson | 24/6 |
| 471,181 | 3/1892 | Laun | 24/6 |
| 1,210,957 | 1/1917 | Lewy | 24/6 |
| 1,691,472 | 11/1928 | Graham et al. | 24/624 |
| 2,089,221 | 8/1937 | Patur et al. | 24/460 |
| 3,392,729 | 7/1968 | Lenoir | 24/462 |
| 3,431,717 | 3/1969 | Avera | 24/462 |
| 3,441,032 | 4/1969 | Barrett | 24/5 |
| 3,735,447 | 5/1973 | Abraham | 24/6 |
| 4,272,869 | 6/1981 | Willner | 24/3 R |

FOREIGN PATENT DOCUMENTS

| | | | |
|---|---|---|---|
| 561818 | 5/1960 | Belgium | 24/460 |

*Primary Examiner*—Victor N. Sakran

*Attorney, Agent, or Firm*—Laff, Whitesel, Conte & Saret

[57] ABSTRACT

This invention is a support for fastening a decorative object such as a flower or corsage to an article of clothing comprising a pair of elements having cooperative shapes such that one clamps into the other, from one side thereof. A decorative object is secured to one of the elements. Accordingly one of the pair of elements can be clamped into the other from opposite sides of the article of clothing, clamping and catching the article of clothing therebetween and securing it thereto.

14 Claims, 6 Drawing Figures

CORSAGE SUPPORT

Figure 1:
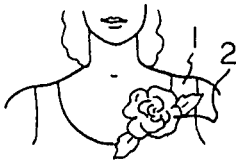

This invention relates to a support for fixing a flower or corsage to an article of clothing such as a dress formed of thin, light, and flexible material.

The problem of fixing a flower or corsage to thin material which often constitutes a lady's dress has long resisted adequate solution. Usually a long pin is used which is threaded into the material and through the stem or several stems of the flowers or binding material of a corsage. Usually a person wearing the corsage has great difficulty in pinning it in proper position with the result that an unbalanced weight tilts the corsage putting strains on the dress material, and particularly if the material is light and flexible, causing unsightly wrinkles. Attempts to pin the corsage by another person is sometimes embarrassing to the wearer. The attempt is often fumbling, requires several attempts to pin it in the desired position, and sometimes results in the person attempting to pin it or the wearer being pricked by the pin. Often the pin is visible where it has been woven out of the material in an attempt to secure it. Consequently a women will often pass the pin through the dress and through her brassiere strap in order to obtain a secure foundation. However this sometimes causes other obvious embarrassing problems while being secured and worn, and is not feasible should the woman be wearing a strapless brassiere or no brassiere at all.

There have been many attempts to solve the problem of securing a flower to an article of clothing. For example, in U.S. Pat. No. 436,110 to Wilcox, a flower holder is attached to a pin, a wire being used to attach the flower to the holder. U.S. Pat. Nos. 3,460,206, 1,425,480, 456,745, 457,973, 670,097, 2,218,157, and 1,489,140 all relate to improvements on the aforenoted patent to Wilcox and relate to various means for holding the flower to a pin. However whatever the techniques for attachment of the flower to the pin, virtually all use either a stright pin or a variation of a safety pin for attachment of the flower to the article of clothing. Consequently the problem of threading the pin through the clothing to effect the attachment remains. Further, if the pin only passes through the material at one place or at two places situated close to each other, the substantial relative weight of the flower which is usually unbalanced relative to the anchor point on the article of clothing eventually causes twisting of the clothing about the anchor point, causing unsightly wrinkles and a poorly arranged flower (either tipped or turning upside-down).

In all of the above cases the securing problem for light, thin and very flexible material remains the same: all use a pin to pass through the material resulting in the embarrassment during application, twisting of the material due to the pin being threaded through the material and the requirement for the use of a relatively secure foundation to support the pin such as a brassiere strap.

The present invention is a support for fixing a decorative object such as a corsage or flower to an article of clothing which does not require the use of a pin threaded through the material. Consequently it can be applied very easily, can be detached and replaced with ease, and does not puncture holes in the material. It does not require the use of a brassiere strap, and consequently can be used on light, flexible, sheer material. Since no pins are used, there is no danger of being pricked during its application.

According to a second embodiment, two points of fixing can be used that are sufficiently wide apart that relatively large corsages can be accommodated with such a large anchor base that the tendency to twist due to unbalanced forces is minimized.

According to the present invention, a flower or corsage is fixed to one element of a pair of clamp elements, one of which is snapped into the other. One element is placed behind and one in front of the dress material. When the two elements are snapped together the dress material is caught therebetween and the elements are locked together with the dress material, thus retaining the flower in place. Wrinkling of the material outside of the general region of the corsage or flower has been found to be substantially eliminated. Further, the mere act of unsnapping the two clamping elements allows the corsage to be moved and reclamped at a new position. Since the elements merely snap together no fumbling is required; the corsage is locked in place merely using a small amount of pressure between the elements until they are locked in place.

In general, the invention is a support for fastening a decorative object such as a flower or corsage to an article of clothing comprising a pair of elements having cooperative shapes such that one clamps into the other, from one side thereof. A decorative object is secured to one of the elements. Accordingly one of the pair of elements can be clamped into the other from opposite sides of the article of clothing, clamping and catching the article of clothing therebetween and securing it thereto.

The invention is also a method of supporting a decorative object such as a flower or corsage to an article of clothing comprising disposing a pair of elements, having cooperative shapes such that one clamps into and is retained by the other under resilient pressure thereof, on opposite sides of material of the article of clothing with the flower or corsage fixed to the element outside of the material on the side of the element opposite the material. The elements are then squeezed toward each other to clamp them together, catching the material therebetween, thus lodging them, and the decorative article to the material.

More particularly, the invention is a support for fastening a decorative object to an article of clothing comprising a U-shaped channel member having a pair of legs having a small degree of resilience therebetween extending from a body joining the legs, the free ends of the legs being turned in toward each other. The body is shaped or apparatus is included for securing the decorative objects to the channel member. A snap member for clamping to the channel member is comprised of a back portion having a width greater than the space between the free ends of the legs and a protrusion from one face of the back portion having a bulbous profile in section. The width of the protrusion spaced from the face is slightly greater than the space between the free ends of the legs. The width of the protrusion adjacent the face is approximately the same as the space between the free ends of the legs. The height of the protrusion is less than the height of the legs, although the invention is not so limited. The protrusion is thus adapted to be snapped between the legs of the channel opposite the body with the material of the article of clothing retained therebetween.

The invention is also a method of supporting a decorative object such as a flower or corsage utilizing the apparatus described above by disposing the channel member with the flower or corsage fixed to the face of the body opposite the legs with the legs next to the material of the article of clothing, disposing the snap member on the other side of the article of clothing with the protrusion facing the legs. The protrusion is then squeezed between the legs of a channel member to catch and retain the material therebetween, whereby the flower or corsage, channel member and snap member are clamped together and are supported by the clothing material.

Figure 2:
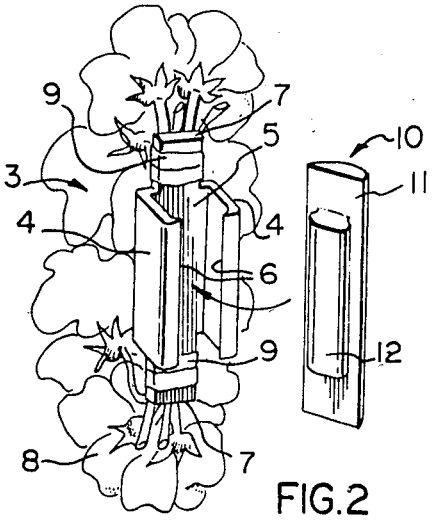
Figure 3:
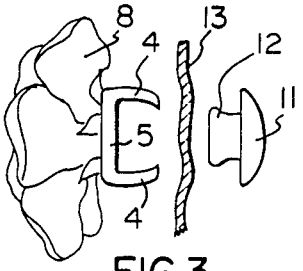
Figure 4:
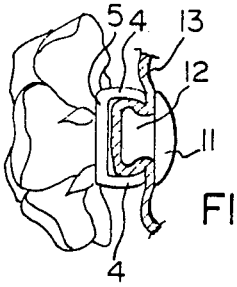
Figure 5:
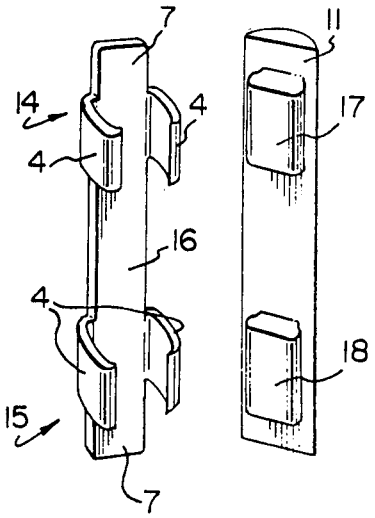
Figure 6:
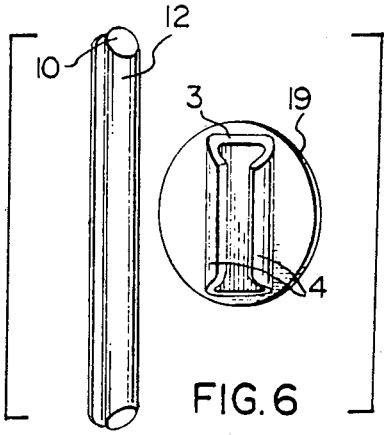

A better understanding of the invention will be obtained by reference to the detailed description below, with reference to the following drawings, in which:

FIG. 1 depicts a person wearing a corsage in the manner contemplated by the invention, FIG. 2 is a perspective showing the elements of one embodiment of the invention, FIGS. 3 and 4 are axial mid-sections showing successive steps of how the invention is used, FIG. 5 is a perspective view of a second embodiment of the invention, and FIG. 6 is a perspective showing the elements of a further embodiment of the invention.

Turning first to FIG. 1, a person is shown wearing a dress 1, which, when used to carry a flower or corsage, is typically light, thin and flexible material. A corsage 2 is intended to be carried by the dress. As described earlier, the usual manner for attachment of such a corsage to the dress is by weaving a pin or several pins through the material of the dress and through the corsage flower stems or support material holding the corsage together, thus retaining the corsage on the dress. The several pins woven through the dress puncture holes, and generally are applied so unevenly that the dress is pinched and left with wrinkles. Further, the person attaching the corsage is usually inexperienced, and there is often much fumbling and embarrassment during its application. In addition, should the corsage not be fastened properly, it must be removed and reapplied, compounding the problem.

The present invention is a support for fastening a flower, corsage, or other decorative feature to an article of clothing with ease, and which does not require the use of pins. One embodiment is shown in FIG. 2.

The preferred embodiment of the invention is comprised of a U-shaped channel member 3 having a pair of legs 4 extending from a body 5. The free ends of the legs are turned in toward each other as shown at 6. The channel member can alternatively be C-shaped or other shape cooperative with a second element to be described below.

A pair of elongate extensions 7 to the body are utilized to provide means for fastening a flower or corsage. One extension extends passed each end of the channel member. A flower or corsage 8 is taped by means of tape or wire 9 to the elongate extensions 7, in order to secure the flower or corsage to the channel member.

Of course other means for fastening the flower or corsage could be used. For example wire can be utilized instead of tape, or indeed a flower clamp or other flower or corsage holder can be fastened to the body of the channel member, .e.g. by rivetting, wiring, gluing, etc. In the latter case the extensions need not be used.

A snap member 10 is provided comprising a back 11 and a protrusion 12 extending from one face of the back. The protrusion should have a bulbous profile in section. The width of the back should be greater than the space between the free ends of the legs 4, the width of the protrusion spaced from the back should be slightly greater than the free ends of the legs, and the width of the protrusion adjacent the face should be approximately the same as the space between the free ends of the legs. The height of the protrusion should be less than the height of the legs.

Preferably the protrusion is elongate, and approximately the same length as the legs 4. However the invention is not restricted thereto, since the protrusion can be shorter or longer than the legs, and indeed, can be shaped as a single circular bulb extending from the face of the back, or a pair of spaced circular bulbs extending therefrom.

Turning to FIGS. 3 and 4, sections of the channel member and snap member are shown during application to an article of clothing. The channel member is placed with its legs 4 facing the material 13 of the dress, the attached corsage 8 facing outwardly. The snap member is placed behind the material of the dress, with is protrusion 12 facing the legs.

The snap member and channel member are then squeezed together, whereby the protrusion is captured between the legs of the channel member with the material 13 clamped therebetween.

At least the legs of the channel member should be formed of resilient material, such as DELRIN ® plastic or other form of plastic, in order that the legs can be pried apart slightly to accommodate the protrusion 12 and material 13.

The clamping action thus causes retention of the snap member, channel member and corsage to the clothing material. In order to remove the corsage, the snap member need merely be pried out from between the legs of the channel member, thus releasing it. Should the position of the corsage be required to be adjusted, it can be moved and refastened merely by squeezing the snap member into position between the legs of the channel member.

The width of the back of the snap member is preferred to be greater than the space between the free ends of the legs of the channel member, in order that the depth of the protrusion between the legs should be controlled. However it is contemplated within the ambit of this invention that the protrusion can be utilized without the back 11. While its use would be considerably more awkward, the protrusion 12 can be made in the form of a dowell which is merely squeezed between the legs of the channel member, thus clamping the material within the channel member. In this case release of the corsage would also be more awkward. Consequently the use of a back 11 is preferred.

Since the back 11 will often be placed directly next to the skin, it is preferred that the side opposite the face should be convexly oval, in order that the skin would not be chaffed. Further, in order to facilitate easy release of the snap member from the channel member, it is preferred that the back should extend past the protrusion 12 in a longitudinal direction. A space between the back and the extension to the body thus is produced, which will accommodate the finger during prying apart of the channel and snap members, and also to accommodate the thickness of tape or wire for fastening the flower or corsage to the extensions of the body of the channel member.

FIG. 5 illustrates a further embodiment of the invention. In this case the channel member is formed into two longitudinally spaced parts 14 and 15, joined by an extension 16 to the body. The extension provides a structure for securing the flower or corsage to the channel member. If desired, further extensions 7 to the body can be used, should a longer or additional surface be required to wind tape or wire or otherwise fasten the flower or corsage.

In this embodiment, the protrusion is also preferred to be formed in two elongated sections 17 and 18, extending from the back 11.

In use, the protrusion sections 17 and 18 are placed opposite the corresponding sets of legs 4, with the material of the article of clothing between them, the back 11 opposite the skin. As in the embodiment of FIG. 2, the protrusions are squeezed between the corresponding sets of legs, catching the material of the clothing therebetween. As a result the apparatus is clamped to the material, and the entire apparatus including the corsage is retained in position.

It should be noted that in this embodiment once the snap member is clamped in the channel member, a space is produced between the extension 16 of the body of the channel member and the back of the snap member. This space accommodates the thickness of tape or wire used to fasten the corsage, as well as the fingers of the user when prying the snap member and channel member apart. Of course extensions of the back of the snap member past the opposite ends of the protrusions 17 and 18 can also facilitate the fingers when prying the members apart.

The embodiment of FIG. 5 is used where the corsage is relatively large, and two widely spaced anchoring points are required.

According to a further embodiment, the first element can be clamped to the article of clothing by the use of a U-shaped spring member which is slid into two opposing vertical channels in the sides of the first element, clamping the article of clothing between the legs of the spring and the first element. Other kinds of spring members which perform a clamping action against the first element can also be used. The roles of the first element and spring member can also be reversed.

Turning to FIG. 6, another embodiment of the invention is shown. In this embodiment, the channel member 3 is made much shorter than the snap member 10. A plate 19, which can be circular, oval or some other shape which does not contain sharp corners is glued or otherwise fastened to the body of the channel member.

In use, the plate is placed inside the article of clothing (and may bear directly against the body of the wearer). Consequently its edge should be chamfered. The snap member 10 has the flower or corsage fastened to it by tape or the like, preferably adjacent its ends. The snap member at the outside of the article of clothing is brought into engagement with the channel member, capturing the clothing of the wearer between its protrusion 12 and the legs 4 of the channel member. The operation is similar to that of FIG. 3, except that the flower or corsage 8 is fastened to the back 11 rather than to the body 5. The plate 19 can be fabricated of a transparent plastic, or can be molded with the channel member 3. The edges, of course, should be smooth in order not to chafe or otherwise poke the wear.

This embodiment has been found to be useful for several reasons. Firstly the portion next to the body is small (e.g. having a plate diameter of approximately 1 inch typically), and therefore has been found to be less noticeable to the wearer within the clothing. Secondly, due to the relatively long length of snap member 10 relative to the channel member 3, it has been found to be easier to apply while locating the flower or corsage in the correct position, since either the flower or the channel member can be located and the remaining portion of the support can be moved and still obtain a region of the opposite member to grip or become gripped. It has therefore been found to be easier to apply than the aforenoted embodiments.

A person understanding this invention may now conceive of variations and other embodiments, using the principles of the present invention. All are considered to be within the sphere and scope of the invention as defined in the claims appended hereto.

I claim:

1. A support for fastening a decorative object to an article of clothing comprising: a U-shaped channel member including a pair of legs having a small degree of resilience extending from a body joining the legs, the free ends of the legs being turned in toward each other, a plate fixed to and covering a face of the body opposite the legs, the plate having smoothed edges, a snap member comprising a back having a width greater than the space between the free ends of the legs, a protrusion from one face of the back having a bulbous profile in section, the width of the protrusion spaced from the face being slightly greater than the space between the free ends of the legs, the width of the protrusion adjacent the face being approximately the same as the space between the free ends of the legs, and the height of the protrusion being less than the height of the legs, the protrusion being adapted to be snapped between the legs of the channel opposite to the body with the material of said article of clothing retained therebetween and without penetrating the material of the clothing.

2. A support as defined in claim 1 in which the securing means is comprised of a pair of elongate extensions of said body, one extension extending past each end of said channel member.

3. A support as defined in claim 1 in which the channel member is formed into two longitudinally spaced parts joined by an extension of said body, said extension forming said securing means, said protrusion being formed into two elongated sections spaced similarly as the channel parts and joined by said back, whereby when the protrusion sections are snapped into corresponding channel parts a space is formed between said body and said back.

4. A support as defined in claim 1 in which the snap member is formed into two elongated sections spaced by an extension of the back, the back forming decorative object securing means, the channel member being formed into two longitudinal parts spaced similarily as the snap member sections, and joined by an extension of said body, whereby when the protrusion sections are snapped into corresponding channel parts a space is formed between the body and the back.

5. A support as defined in claim 4 further including a pair of elongate extensions of said body, one extension extending past each of the opposite ends of said channel parts.

6. A support as defined in claim 1 or 2 in which the protrusion is elongated along the axis of the back.

7. A support member as defined in claim 1 or 2 in which the protrusion is elongated along the axis of the back and has a length approximately the same as the length of the legs along the body.

8. A support as defined in claim 4 or 5 in which the lengths of the legs along the body are approximately the same.

9. A support as defined in claim 4 or 5 in which the protrusions are elongated along the axis of the back, each having approximately the same lengths as the lengths of the legs along the body.

10. A support as defined in claim 1 or 2 in which said back has a smoothly convex shape over at least the major part of its surface opposite to the protrusion.

11. A support as defined in claim 1, 2 or 4 further including at least one flower and a tape wound around the stem of said flower and an extension of the body whereby the flower is retained along the body on a side opposite the legs, substantially hiding the body from view opposite the legs.

12. A support as defined in claim 5 further including at least one flower and a tape wound around the stem of said flower and said extensions of the body whereby the flower is retained along the body on a side opposite the legs, substantially hiding the body from view opposite the legs.

13. A support for fastening a decorative object to an article of clothing comprising: a U-shaped channel member including a pair of legs having a small degree of resilience extending from a body joining the legs, the free ends of the legs being turned in toward each other, a plate fixed to and covering a face of the body opposite the legs, the plate having smoothed edges, a snap member comprising a back having a width greater than the space between the free ends of the legs, a protrusion from one face of the back having a bulbous profile in section, the width of the protrusion spaced from the face being slightly greater than the space between the free ends of the legs, the width of the protrusion adjacent the face being approximately the same as the space between the free ends of the legs, and the height of the protrusion being less than the height of the legs, the protrusion being adapted to be snapped between the legs of the channel opposite to the body with the material of said article of clothing retained therebetween and without penetrating the material of the clothing, the snap member being substantially longer than the channel member, and means for securing the decorative object to the snap member.

14. A support as defined in claim 13, in which the plate is round or oval in shape.

* * * * *